US010193232B2

(12) United States Patent
Yang et al.

(10) Patent No.: US 10,193,232 B2
(45) Date of Patent: Jan. 29, 2019

(54) DOUBLE-LAYER PLANAR PHASE MODULATION DEVICE

(71) Applicant: Tsinghua University, Beijing (CN)

(72) Inventors: Fan Yang, Beijing (CN); Wenxing An, Beijing (CN); Shenheng Xu, Beijing (CN); Maokun Li, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 189 days.

(21) Appl. No.: 15/214,517

(22) Filed: Jul. 20, 2016

(65) Prior Publication Data

US 2017/0025727 A1 Jan. 26, 2017

(30) Foreign Application Priority Data

Jul. 20, 2015 (CN) ..... 2015 1 0428733

(51) Int. Cl.
*H01Q 3/46* (2006.01)
*H01Q 15/00* (2006.01)

(52) U.S. Cl.
CPC ..... *H01Q 15/0026* (2013.01); *H01Q 3/46* (2013.01)

(58) Field of Classification Search
CPC ..... H01P 1/18; G07K 7/077; G07K 7/073
See application file for complete search history.

(56) References Cited

U.S. PATENT DOCUMENTS

2005/0110685 A1* 5/2005 Frederik du Toit ..... H01Q 9/0414 343/700 MS
2010/0039345 A1* 2/2010 Kim ..... H01Q 9/0407 343/846
2012/0223142 A1* 9/2012 Wang ..... H01Q 1/2216 235/462.25

OTHER PUBLICATIONS

Chen, Yang et al., "A C-Band Flat Lens Antenna With Double-Ring Slot Elements", IEEE Antennas and Wireless Propagation Letters, Feb. 20, 2013, vol. 12, 341-344.
De Vita, P. et al., "Broadband Element for High-Gain Single-Layer Printed Reflectarray Antenna", Electronics Letters, Nov. 8, 2007, vol. 43, No. 23, 2 pages.
Pan, Wenbo et al., "A Dual Linearly Polarized Transmitarray Element With 1-Bit Phase Resolution in X-Band", IEEE Antennas and Wireless Propagation Letters, Sep. 16, 2014, vol. 14, 167-169.
Munk, Ben A., "Frequency Selective Surfaces: Theory and Design", 2000, Chapter 2, 26-35, John Wiley & Sons Co.

* cited by examiner

*Primary Examiner* — Jeffrey Shin
(74) *Attorney, Agent, or Firm* — Hodgson Russ LLP

(57) ABSTRACT

The present disclosure provides a double-layer planar phase modulation device. The double-layer planar phase modulation device includes an upper patch; and a lower patch, disposed opposite to the upper patch, in which a shape of the lower patch is similar to that of the upper patch, and the lower patch is electrically connected with the upper patch.

15 Claims, 7 Drawing Sheets

DOUBLE-LAYER PLANAR PHASE MODULATION DEVICE

RELATED APPLICATIONS

This application claims priority and benefits of Chinese Patent Application No. 201510328733.X, filed with State Intellectual Property Office on Jul. 20, 2015, the entire content of which is incorporated herein by reference.

FIELD

The present disclosure relates to a phase modulation device, and more particularly to a double-layer planar phase modulation device.

BACKGROUND

A phase modulation device in the prior art adopts a structure of at least a three layers, and thus has a complicated structure and a high manufacturing cost.

SUMMARY

Embodiments of the present disclosure seek to solve at least one of the problems existing in the related art to at least some extent. Thus, the present disclosure provides a double-layer planar phase modulation device having advantages of an easy structure, a low manufacturing cost and a superior performance.

The double-layer planar phase modulation device according to embodiments of the present disclosure includes an upper patch; and a lower patch, disposed opposite to the upper patch, in which a shape of the lower patch is similar to that of the upper patch, and the lower patch is electrically connected with the upper patch.

The double-layer planar phase modulation device according to embodiments of the present disclosure adopts the upper patch and the lower patch to constitute a double-layer structure, thus simplifying a structure of the phase modulation device, enlarging a phase modulation range thereof, and also improving the phase modulation flexibility of the phase modulation device.

According to an embodiment of the present disclosure, the upper patch is configured as a centrosymmetrical structure.

In an embodiment of the present disclosure, the upper patch has a regular-polygon shape, each corner of the upper patch is provided with an upper groove extending along a radial direction of the upper patch, an external end of the upper groove is open; and each corner of the lower patch is provided with an lower groove extending along a radial direction of the lower patch, and an external end of the lower groove is open.

According to an embodiment of the present disclosure, the upper groove runs through the upper patch along an up-down direction.

According to an embodiment of the present disclosure, the lower groove runs through the lower patch along the up-down direction.

Preferably, an internal end of each upper groove is spaced apart from a center of the upper patch by a predetermined distance, and an internal end of each lower groove is spaced apart from a center of the lower patch by the predetermined distance, in which the predetermined distance is determined by an operation frequency of the double-layer planar phase modulation device and sizes of the upper patch and the lower patch.

Further, a length of each upper groove is in a linear relationship with a side length of the upper patch; and a length of each lower groove is in a linear relationship with a side length of the lower patch.

According to an embodiment of the present disclosure, the upper patch is connected with the lower patch via a plurality of conductive members, and the conductive member is configured as a metal via hole or a metal pillar, in which one end of the conductive member is connected with the upper patch, and the other end of the conductive member is connected with the lower patch.

Preferably, one conductive member is disposed between two adjacent upper grooves, one conductive member is disposed between two adjacent lower grooves, and one upper groove and one lower groove are disposed between two adjacent conductive members.

According to an embodiment of the present disclosure, the two adjacent conductive members are symmetrical with respect to the upper groove located therebetween, and the two adjacent conductive members are symmetrical with respect to the lower groove located therebetween.

In another embodiment of the present disclosure, the upper patch includes a first upper main part and a second upper main part intersecting with the first upper main part, in which each of the first upper main part and the second upper main part is configured to have a long strip shape; and the lower patch includes a first lower main part and a second lower main part intersecting with the first lower main part, in which each of the first lower main part and the second lower main part is configured to have a long-strip shape.

According to an embodiment of the present disclosure, the first upper main part and the second upper main part are perpendicular to each other and bisected by each other; and the first lower main part and the second lower main part are perpendicular to each other and bisected by each other.

According to an embodiment of the present disclosure, the upper patch further includes an upper end strip, and the upper end strip is disposed at a free end of at least one of the first upper main part and the second upper main part; and the lower patch further includes a lower end strip, and the lower end strip is disposed at a free end of at least one of the first lower main part and the second lower main part.

Optionally, an extending direction of the upper end strip is perpendicular to an extending direction of the corresponding first upper main part or second upper main part; and an extending direction of the lower end strip is perpendicular to an extending direction of the corresponding first lower main part or second lower main part.

Preferably, the upper end strip is symmetrical with respect to the first upper main part or the second upper main part where the upper end strip is disposed, and the lower end strip is symmetrical with respect to the first lower main part or the second lower main part where the lower end strip is disposed.

Optionally, an end of the upper end strip is connected to the corresponding first upper main part or second upper main part; and an end of the lower end strip is connected to the corresponding first lower main part or second lower main part.

According to an embodiment of the present disclosure, the upper patch is connected with the lower patch via a plurality of conductive members, and the conductive member is configured as a metal via hole or a metal pillar, in which one end of the conductive member is connected with the upper patch, and the other end of the conductive member is connected with the lower patch.

Further, a central axis of the conductive member passes through an intersection of the first upper main part and the second upper main part, and the central axis of the conductive member passes through an intersection of the first lower main part and the second lower main part.

Further, the intersection of the first upper main part and the second upper main part is denoted as A, the intersection of the first lower main part and the second lower main part is denoted as B, and a connection line between intersections A and B is defined as a straight line AB; and a plurality of the conductive members are provided, an upper end of each conductive member is connected to the upper patch and a lower end of each conductive member is connected to the lower patch, a straight line where each conductive member is located is parallel to the straight line AB, and the plurality of the conductive members are distributed evenly along a circumferential direction of the straight line AB.

According to some embodiments of the present disclosure, the double-layer planar phase modulation device further includes an insulating dielectric layer, disposed between the upper patch and the lower patch.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
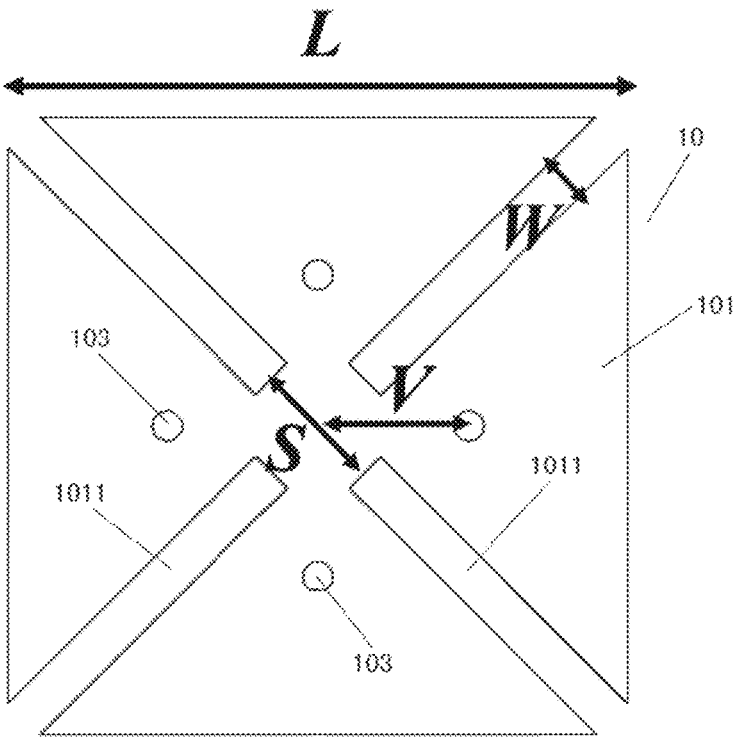
FIG. 1 is a schematic view of a double-layer planar phase modulation device according to embodiments of the present disclosure.

Embodiments of the present disclosure will be described in detail below, and examples of the embodiments are shown in accompanying drawings. The embodiments described herein with reference to drawings are explanatory, illustrative, and used to generally understand the present disclosure. The embodiments shall not be construed to limit the present disclosure.

A double-layer planar phase modulation device 10 according to embodiments of the present disclosure will be described herein with reference to FIGS. 1-12. The double-layer planar phase modulation device 10 may be used for designing microwave devices (such as an antenna array, a radome, a filter, etc.) and circuits. As shown in FIGS. 1-4, the double-layer planar phase modulation device 10 according to embodiments of the present disclosure includes an upper patch 101 and a lower patch 102.

Specifically, the lower patch 102 is disposed opposite to the upper patch 101, a shape of the lower patch 102 is similar to that of the upper patch 101, and the lower patch 102 is electrically connected with the upper patch 101. It should be noted that, "similar shapes" herein may refer to same shapes having different sizes. For example, the upper patch 101 may be configured to have a quadrilateral shape, and the lower patch 102 may be configured to have a shape which has a corresponding angle equal to that of the upper patch 101 and a corresponding side proportional to that of the upper patch 101. A planar phase modulation device in the prior art usually adopts a structure of at least a three layers, and thus has a relatively complicated and a high cost. The present application provides the double-layer planar phase modulation device for the first time, which reduces sharply the structure complexity of the double-layer planar phase modulation device, and processing and manufacturing costs thereof, and thus opens up a new field for research of the double-layer planar phase modulation device.

The double-layer planar phase modulation device 10 according to embodiments of the present disclosure adopts the upper patch 101 and the lower patch 102 to constitute a double-layer structure, thus simplifying the structure of the phase modulation device, enlarging a phase modulation range thereof, and also improving the phase modulation flexibility of the phase modulation device.

As shown in FIGS. 1-12, in an embodiment of the present disclosure, the upper patch 101 may be configured as a centrosymmetrical structure. Thus, the structure of the double-layer planar phase modulation device 10 can be simplified, the manufacturing cost of the double-layer planar phase modulation device 10 can be reduced, and the working performance of the double-layer planar phase modulation device 10 can be improved, so that it is suitable for the double-layer planar phase modulation device 10 to be used for designing the microwave devices such as the antenna array, the radome, the filter, etc.) and the circuits. Furthermore, a dimension of the upper patch 101 is identical with that of the lower patch 102. Thus, the working performance of the double-layer planar phase modulation device 10 may be further improved and the manufacturing cost of the double-layer planar phase modulation device 10 may be further reduced.

Advantageously, the upper patch 101 includes an upper dielectric layer, a first upper metal patch part disposed on an upper surface of the upper dielectric layer and a first lower metal patch part disposed on a lower surface of the upper dielectric layer. The lower patch 102 includes a lower dielectric layer, a second upper metal patch part disposed on an upper surface of the lower dielectric layer and a second lower metal patch part disposed on a lower surface of the lower dielectric layer.

Herein, materials of the upper dielectric layer and the lower dielectric layer are not restricted particularly. For example, both of the upper dielectric layer and the lower dielectric layer are made of Arlon AD255 series of board materials, whose relative permittivity is 2.55, loss tangent value is 0.0014, and thickness is 0.1052. Herein, it should be noted that λ represents a wavelength corresponding to an operation frequency of the double-layer planar phase modulation device according to embodiments of the present disclosure, and the same as follows.

The double-layer planar phase modulation device 10 further includes an insulating dielectric layer, which is disposed between the upper patch 101 and the lower patch 102. Thus, the performance of the double-layer planar phase modulation device 10 may be further improved, and the working stability of the double-layer planar phase modulation device 10 can be ensured. Furthermore, a thickness of each of the upper patch 101, the lower patch 102 and the insulating dielectric layer is 0.0001λ-0.2λ. Thus, the working performance of the double-layer planar phase modulation device 10 can be improved, and the working stability of the double-layer planar phase modulation device 10 can be ensured. Optionally, the thickness of each of the upper patch 101, the lower patch 102 and the insulating dielectric layer is 0.0002λ-0.05λ or 0.06λ-0.2λ. Thus, by decreasing the thickness of the metal patch, the weight of the whole device can be reduced, and the transportation convenience thereof also is improved; moreover, the parasitic capacitance distribution introduced by adjacent metal patches can be reduced, and thus the stability of the device can be enhanced; in addition, the electrical conductivity of the patch can be enhanced, and thus it is easy to realize impedance matching, so that magnitude characteristics of the phase compensation device can be effectively improved and a broader phase compensation range can be achieved.

Preferably, the thickness of each of the upper patch 101, the lower patch 102 and the insulating dielectric layer is 0.0023λ. Thus, the working performance of the double-layer planar phase modulation device 10 can be further improved, and the working stability of the double-layer planar phase modulation device 10 can be ensured.

The double-layer planar phase modulation device 10 will be described in detail in the following with reference to two specific embodiments. It should be understood that, descriptions below are just explanatory and illustrative, which shall not be construed to limit the present disclosure.

Embodiment 1

As shown in FIGS. 1-9, in the present embodiment, the upper patch 101 may be a centrosymmetrical structure. Thus, the structure of the double-layer planar phase modulation device 10 can be simplifies, the manufacturing cost of the double-layer planar phase modulation device 10 can be reduced, and the working performance of the double-layer planar phase modulation device 10 can be improved, so that it is suitable for the double-layer planar phase modulation device 10 to be used for designing of microwave devices such as an antenna array, a radome, a filter, etc.) and circuits. Since the lower patch 102 has a same shape as the upper patch 101, the lower patch 102 is configured as a centrosymmetrical structure too. Furthermore, a dimension of the upper patch 101 is equal to that of the lower patch 102. Thus, the working performance of the double-layer planar phase modulation device 10 can be further improved, and the manufacturing cost of the double-layer planar phase modulation device 10 can be further reduced.

The upper patch 101 has a regular-polygon shape, and each corner of the upper patch 101 is provided with an upper groove 1011 extending along a radial direction of the upper patch 101. An external end of the upper groove 1011 is open. The lower patch 102 has a same shape as the upper patch 101, i.e. the lower patch 102 also has a regular-polygon shape. Each corner of the lower patch 102 is provided with a lower groove 1021 extending along a radial direction of the lower patch 102. An external end of the lower groove 1021 is open.

Figure 2:
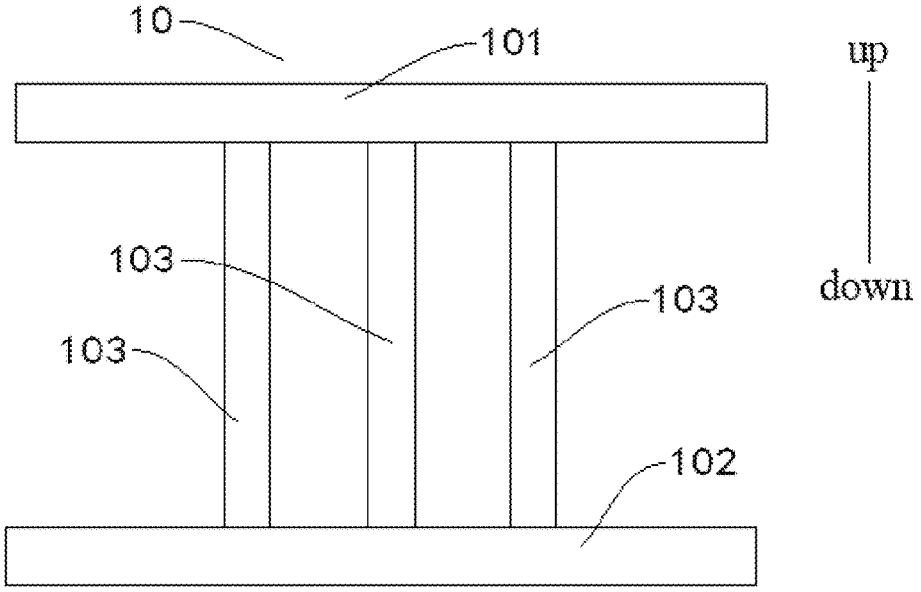
FIG. 2 is a schematic view of a double-layer planar phase modulation device according to embodiments of the present disclosure.
Figure 3:
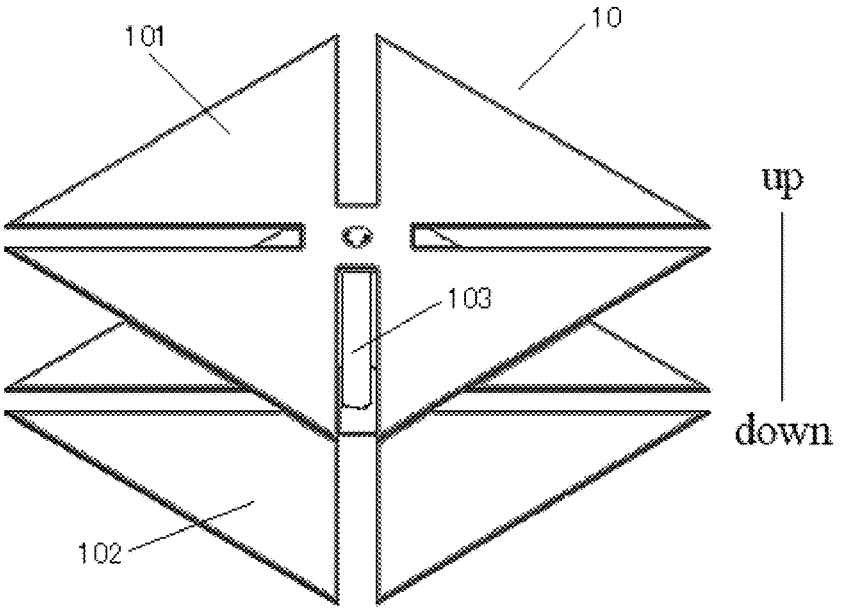
FIG. 3 is a schematic view of a double-layer planar phase modulation device according to embodiments of the present disclosure.
Figure 4:
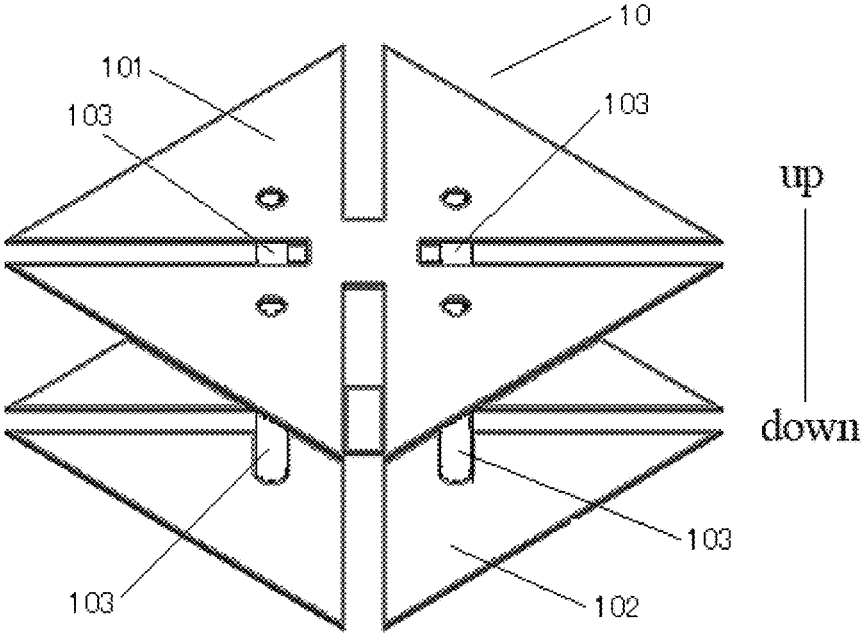
FIG. 4 is a schematic view of a double-layer planar phase modulation device according to embodiments of the present disclosure.
Figure 5:
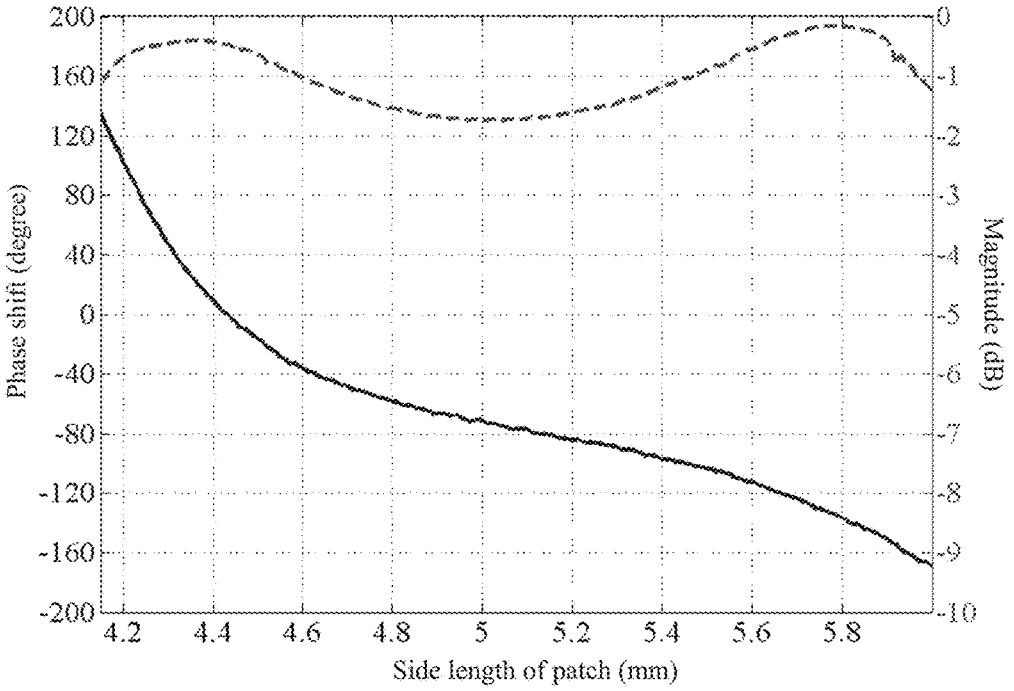
FIG. 5 is a magnitude-phase characteristic diagram of a double-layer planar phase modulation device according to embodiments of the present disclosure.

Optionally, the upper groove 1011 runs through the upper patch 101 along an up-down direction (as shown in FIGS. 2-4), and thus the working performance of the double-layer planar phase modulation device 10 can be improved. Similarly, the lower groove 1021 runs through the lower patch 102 along the up-down direction (as shown in FIGS. 2-4). Of course, when the upper groove 1011 runs through the upper patch 101 along the up-down direction s shown in FIGS. 2-4), the lower groove 1021 may run through the lower patch 102 along the up-down direction as well (as shown in FIGS. 2-4). Thereby, the working performance of the double-layer planar phase modulation device 10 can be further improved.

Herein, a length of a connection line between a center of a regular polygon and a top point of a regular polygon is called a radius of the regular polygon. In other words, the radial direction of the upper patch 101 refers to a direction of a connection line between a center of the upper patch 101 and a top point of the upper patch 101, and the radial direction of the lower patch 102 refers to a direction of a connection line between a center of the lower patch 102 and a top point of the lower patch 102.

The existing planar phase modulation device usually adopts a structure of at least three layers, and thus has a complicated structure and a high cost. The present application provides the double-layer planar phase modulation device for the first time, which reduces sharply the structure complexity of the double-layer planar phase modulation device, and processing and manufacturing costs, and thus opens up a new field for research of the double-layer planar phase modulation device.

In the double-layer planar phase modulation device 10 according to embodiments of the present disclosure, by providing the upper groove 1011 at each corner of the upper patch 101 and providing the lower groove 1021 at each corner of the lower patch 102, the number of resonance structures is increased, thereby improving the performance of the double-layer planar phase modulation device 10.

The double-layer planar phase modulation device 10 according to embodiments of the present disclosure, by adjusting side lengths L of the upper patch 101 and the lower patch 102, may flexibly modulate its own phase and still keep a good working performance when an incident wave is injected obliquely, however an ordinary all-metal element cannot achieve this. In other words, a magnitude-phase characteristic of the double-layer planar phase modulation device 10 varies along with changes of the side lengths L of the upper patch 101 and the lower patch 102.

Thus, the double-layer planar phase modulation device 10 according to embodiments of the present disclosure has advantages of an easy structure, a low manufacturing cost and a superior performance, and thus may be used for the design of the microwave devices such as the antenna array, the radome, the filter, etc.) and the circuits.

As shown in FIGS. 1-4, the double-layer planar phase modulation device 10 includes the upper patch 101 and the lower patch 102.

The shape of the upper patch 101 is same with that of the lower patch 102, and the dimension of the upper patch 101 is identical to that of the lower patch 102. Specifically, each of the upper patch 101 and the lower patch 102 may has a square shape.

The upper patch 101 and the lower patch 102 may have a same structure. Center frequency of each of the upper patch 101 and lower patch 102 is 20 GHz, and the element periodicity thereof may be 0.1λ-0.75λ. Optionally, the element periodicity is 0.2λ-0.5λ or 0.5λ-0.75λ. It should be noted that, a sub-wavelength structure may effectively broaden a working bandwidth of a system, and a half-wavelength structure and an over-half-wavelength structure can effectively increase a variation range of the patch dimension, thus realizing the broader phase compensation range.

For example, the center frequency of each of the upper patch 101 and lower patch 102 is 20 GHz, and the element periodicity thereof is 0.43λ, which is 0.43 times the wavelength corresponding to the operation frequency. That is to say, the wavelength corresponding to the operation frequency of the double-layer planar phase modulation device 10 according to embodiments of the present disclosure is λ.

The double-layer planar phase modulation device 10 further includes an insulating dielectric layer, which is disposed between the upper patch 101 and the lower patch 102.

Herein, the material of the insulating dielectric layer is not restricted particularly. For example, the insulating dielectric layer is made of Arlon AD255 series of board materials, whose relative permittivity is 2.55, loss tangent value is 0.0014, and thickness is 0.01λ-0.3λ. Optionally, when the thickness of board materials is configured to be 0.05λ-0.1λ or 0.1λ-0.3λ, the broader phase compensation range can be realized, and the working stability of the double-layer planar phase modulation device 10 can be improved; furthermore, a production cost thereof can be saved, and the manufacturing difficulty can be reduced, so as to decrease an phase modulation error introduced by a processing error. Verified by a test, when the insulating dielectric layer is made of the Arlon AD255 series of materials, whose relative permittivity is 2.55, loss tangent value is 0.0014, and thickness is 0.105λ, the stability of the double-layer planar phase modulation device 10 is better.

Furthermore, the thickness of each of the upper patch 101, the lower patch 102 and the insulating dielectric layer is 0.0001λ-0.2λ. Thus, the working performance of the double-layer planar phase modulation device 10 can be improved, and the working stability of the double-layer planar phase modulation device 10 can be ensured. Optionally, the thickness of each of the upper patch 101, the lower patch 102 and the insulating dielectric layer is 0.0002λ-0.05λ or 0.06λ-0.2λ. Thus, by decreasing the thickness of the metal patch, the weight of the whole device can be reduced, and the transportation convenience thereof also is improved, moreover, the parasitic capacitance distribution introduced by adjacent metal patches can be reduced, and thus the stability of the device can be enhanced, in addition, the electrical conductivity of the patch can be enhanced, and thus it is easy to realize impedance matching, so that magnitude characteristics of the phase compensation device can be effectively improved and the broader phase compensation range can be achieved.

For example, when the thickness of each of the upper patch 101, the lower patch 102 and the insulating dielectric layer is 0.0023λ, the phase compensation range of the double-layer planar phase modulation device 10 is broader, and the magnitude characteristics of the double-layer planar phase modulation device 10 is better.

In an embodiment of the present disclosure, an internal end of each upper groove 1011 is spaced apart from the center of the upper patch 101 by a predetermined distance S/2, and an internal end of each lower groove 1021 is spaced apart from the center of the lower patch 102 by the predetermined distance S/2.

Preferably, the predetermined distance S/2 is 0.01λ-0.3λ, a width W of each upper groove 1011 is 0.01λ-0.2λ, and a length of each upper groove 1011 is in a linear relationship with the side length of the upper patch 101. A width of each lower groove 1021 is 0.01λ-0.2λ, and a length of each lower groove 1021 is in a linear relationship with the side length of the lower patch 102. Preferably, the predetermined distance S/2 is 0.02λ-0.05λ or 0.06λ-0.3λ, thus effectively guiding a distribution of a high frequency current on the patch surface, so as to realize the broader phase compensation range, and also reducing the parasitic capacitance distribution introduced by grooving, so as to improve the stability of the double-layer planar phase modulation device 10.

Further preferably, the predetermined distance S/2 is 0.026λ the width W of each upper groove 1011 is 0.02λ and the width of each lower groove 1021 is 0.02λ.

As shown in FIG. 3, in an embodiment of the present disclosure, the double-layer planar phase modulation device 10 further includes a conductive member. One end of the conductive member is connected with the upper patch 101, and the other end of the conductive member is connected with the lower patch 102. Thus, the working performance of the double-layer planar phase modulation device 10 can be further improved. Preferably, a plurality of the conductive members may be provided. Thus, it is convenient to improve the connection stability of the upper patch 101 and the lower patch 102.

Further, one conductive member is disposed between two adjacent upper grooves 1011, one conductive member is disposed between two adjacent lower grooves 1021, and one upper groove 1011 and one lower groove 1021 are disposed between two adjacent conductive members. Thus, the connection stability of the upper patch 101 and the lower patch 102 can be improved. Further, the two adjacent conductive members are symmetrical with respect to the upper groove, and the two adjacent conductive members are symmetrical with respect to the lower groove.

Optionally, the conductive member may be configured as a metal via hole or a metal pillar. Thus, structure diversity of the double-layer planar phase modulation device 10 can be improved.

For example, the conductive member is a metal via hole 103, an upper end of the metal via hole 103 is connected with the upper patch 101, and a lower end of the metal via hole 103 is connected with the lower patch 102. Those skilled in the related art should understand that the metal via hole refers to an assembly of a hole and a metal layer, in which the metal layer is coated on an inner circumferential wall of the hole and extends out of the hole. Thus, the upper end of the metal via hole 103 refers to an upper end of the metal layer, and the lower end of the metal via hole 103 refers to a lower end of the metal layer.

Optionally, a central axis of the metal via hole 103, a central line of the upper patch 101, and a central line of the lower patch 102 are coincident with one another. That is to say, the upper end of the metal via hole 103 is connected with the center of the upper patch 101, and the lower end of the metal via hole 103 is connected with the center of the lower patch 102. In other words, the metal via hole 103 may be configured as a central metal via hole.

The double-layer planar phase modulation device 10 without the metal via hole 103 adopts an indirect coupling manner, and the coupling thereof is relatively weak. A receiving/transmitting element structure adopts a coupling structure (such as a transmission line) and transmits the received signal directly to an emitting port, but due to the dissymmetrical structure thereof, the receiving/transmitting element is not suitable for a design of a completely polarimetric antenna. Simultaneously, the transmission structure of the receiving/transmitting element also occupies a layer of element structure, thus increasing the structure complexity.

In order to enhance the coupling degree of the double-layer planar phase modulation device 10, the transmission structure in the receiving/transmitting element is introduced into the double-layer planar phase modulation device 10, and a symmetrical structure design is adopted to make the receiving/transmitting element suitable for the complete polarization application.

The double-layer planar phase modulation device 10 according to embodiments of the present disclosure, by providing the metal via hole 103, can improve the performance of the double-layer planar phase modulation device 10.

As shown in FIG. 4, in another embodiment of the present disclosure, the double-layer planar phase modulation device 10 further includes a plurality of the metal via holes 103, the upper end of each metal via hole 103 is connected with the upper patch 101, and the lower end of each metal via hole 103 is connected with the lower patch 102. One metal via hole 103 is provided between the two adjacent upper grooves 1011, one metal via hole 103 is provided between the two adjacent lower grooves 1021, and one upper groove 1011 and one lower groove 1021 are provided between two adjacent metal via holes 103.

That is to say, the plurality of the metal via holes 103 and a plurality of the upper moves 1011 are distributed alternately, and the plurality of the metal via holes 103 and a plurality of the lower grooves 1021 are distributed alternately, as well.

The double-layer planar phase modulation device 10 according to embodiments of the present disclosure, by disposing the plurality of the metal via holes 103, may further improve the performance of the double-layer planar phase modulation device 10. Compared with the double-layer planar phase modulation device 10 without the metal via hole 103, the double-layer planar phase modulation device 10 with the plurality of the metal via holes 103 can improve the phase compensation range thereof from 180° to 305°, and also increase the element magnitude from below −5 dB to −1 dB.

As shown in FIG. 4, in some embodiments of the present disclosure, the two adjacent metal via holes 103 are symmetrical with respect to the upper groove 1011, and the two adjacent metal via holes 103 are also symmetrical with respect to the lower groove 1021. Thus, the structure of the double-layer planar phase modulation device 10 is allowed to be more reasonable.

The metal via hole 103 has functions of the transmission line, and couples received energy directly to the emitting port, which thus replaces the indirect coupling.

The distance between the metal via hole 103 and the center of the upper patch 101 changes along with the dimension change of the upper patch 101, and the distance between the metal via hole 103 and the center of the lower patch 102 changes along with the dimension change of the lower patch 102.

Preferably, a distance between the metal via hole 103 and the center of the upper patch 101 is 0.01-0.4 times the side length of the upper patch 101, and a distance between the metal via hole 103 and the center of the lower patch 102 is 0.01-0.4 times the side length of the lower patch 102. Preferably, the distance between the metal via hole 103 and the center of the upper patch 101 is 0.02-0.05 or 0.06-0.4 times the side length of the upper patch 101, and the distance between the metal via hole 103 and the center of the lower patch 102 is 0.02-0.05 or 0.06-0.4 times the side length of the lower patch 102, thus effectively guiding the distribution of the high frequency current on the patch surface, so as to realize the broader phase compensation range, and also reducing the parasitic capacitance distribution introduced by the adjacent metal via holes or adjacent electrical connections by enlarging the distance between the metal via holes 103, so as to improve the stability of the double-layer planar phase modulation device 10. For example, the distance between the metal via hole 103 and the center of the upper patch 101 is 0.244 times the side length of the upper patch 101, and the distance between the metal via hole 103 and the center of the lower patch 102 is 0.244 times the side length of the lower patch 102.

Further, an inner diameter of the metal via hole 103 is 0.001λ-0.2λ. Optionally, the inner diameter of the metal via hole 103 is 0.005λ-0.05λ or 0.06λ-0.2λ. Thus, by decreasing the dimension of the metal via hole 103, the parasitic capacitance distribution introduced by the adjacent metal via holes or the adjacent electrical connects can be reduced, and thereby the stability of the double-layer planar phase modulation device 10 can be improved; moreover, the coupling degree between the upper and lower patches can be enhanced, the distribution of the high frequency current on the surfaces of the upper and lower patches can be effectively guided, and thereby the broader phase compensation range can be realized.

Further, a wall thickness of the metal via hole 103 is 0.0001λ-0.2λ. Optionally, the wall thickness of the metal via hole 103 is 0.0002λ-0.05λ or 0.06λ-0.2λ. Thus, by decreasing the wall thickness of the metal via hole 103, the parasitic capacitance distribution introduced by the adjacent metal via holes or the adjacent electrical connections can be reduced, and thereby the stability of the double-layer planar phase modulation device 10 can be improved; moreover, the coupling degree between the upper and lower patches can be enhanced, the distribution of the high frequency current on the surfaces of the upper and lower patches can be effectively guided, and thereby the broader phase compensation range can be realized. For example, the inner diameter of the metal via hole 103 is 0.013λ, and the wall thickness of the metal via hole 103 is 0.0013λ.

A full-wave-analysis electromagnetic simulation software Ansoft HFSS based on the finite element method is adopted to calculate element characteristics of the double-layer planar phase modulation device 10. Considering a coupling effect of adjacent elements, the infinite array approach is adopted, and the double-layer planar phase modulation device 10 is placed in a periodic circumstance, to use a periodic boundary condition to accurately and effectively truncate the calculation area, so as to improve efficiency of the numerical analysis.

Figure 6:
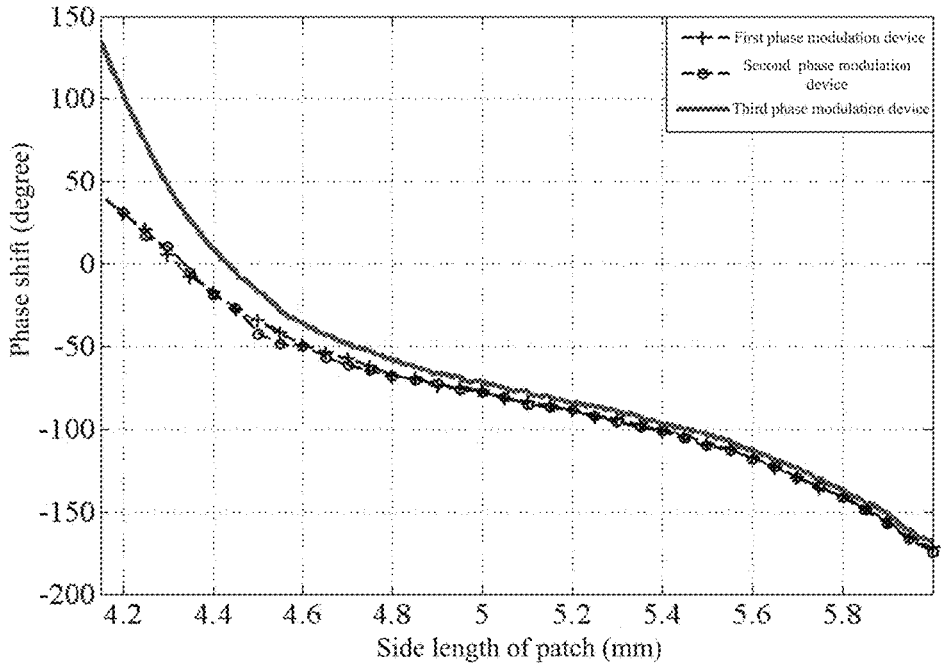
FIG. 6 is a phase response graph of a double-layer planar phase modulation device according to embodiments of the present disclosure.
Figure 7:
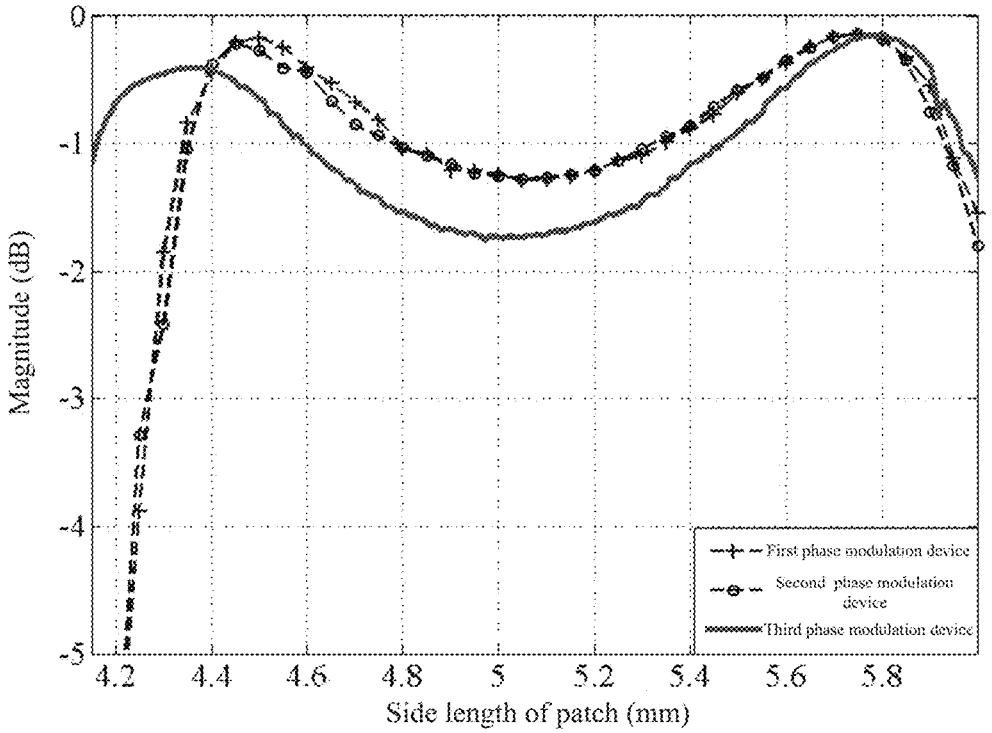
FIG. 7 is a magnitude response graph of a double-layer planar phase modulation device according to embodiments of the present disclosure.

The double-layer planar phase modulation device 10 without the metal via hole 103 is referred as a first phase modulation device, the double-layer planar phase modulation device 10 with one metal via hole 103 (the central metal via hole) is referred as a second phase modulation device (as shown in FIG. 3), and the double-layer planar phase modulation device 10 with a plurality of the metal via holes 103 is referred as a third phase modulation device (as shown in FIG. 4). Phase response graphs and magnitude response graphs of the three phase modulation devices are shown in FIGS. 6 and 7.

The first phase modulation device has a limited 1 dB phase compensation range, which is just about 180°. The phase and magnitude performances of the second phase modulation device are substantially consistent with those of the first phase modulation device, and the main reason is that, when the metal via hole 103 is placed in the center of the double-layer planar phase modulation device 10, due to the symmetry of a metal structure, a current of a central part of the metal structure is zero, so the metal via hole 103 has little or no effect on the performance of the double-layer planar phase modulation device 10.

Compared with the first phase modulation device and the second phase modulation device, the third phase modulation device may improve sharply the phase and magnitude responses. Especially, when the dimensions of the upper patch 101 and the lower patch 102 are relatively small, an upper limit of the phase compensation of the double-layer planar phase modulation device 10 (the third phase modulation device) is increased from 40° to 140°, i.e. the phase compensation range is increased by 100°, and the element magnitude is promoted from below −5 dB to −1 dB.

Figure 8:
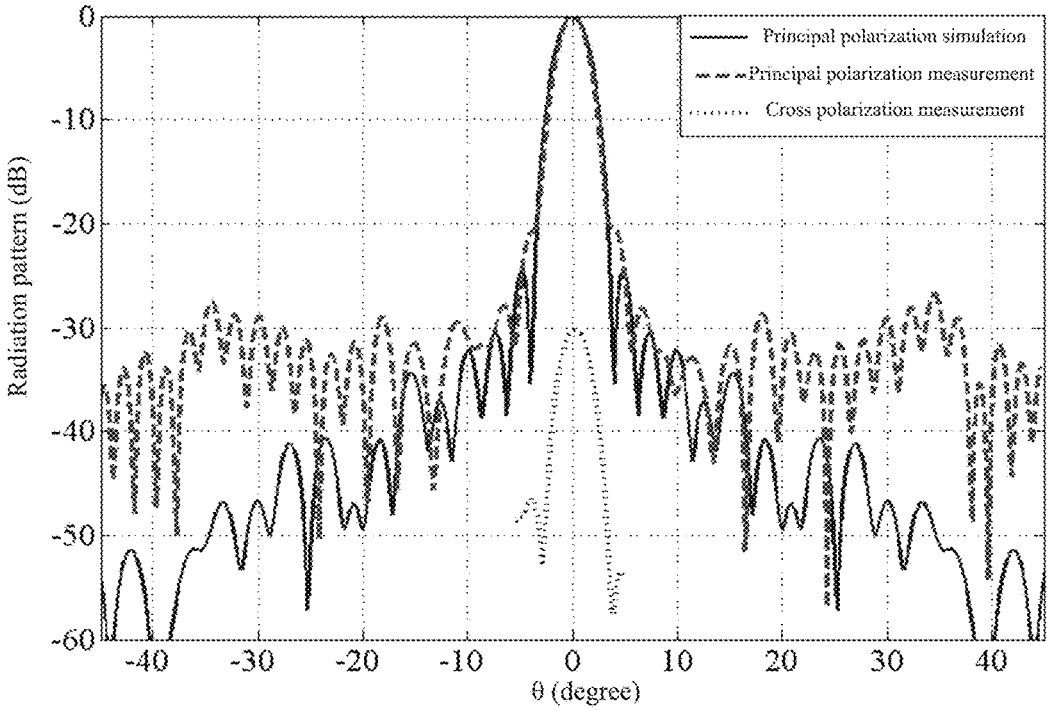
FIG. 8 is an E-plane pattern of a double-layer planar phase modulation device according to embodiments of the present disclosure.
Figure 9:
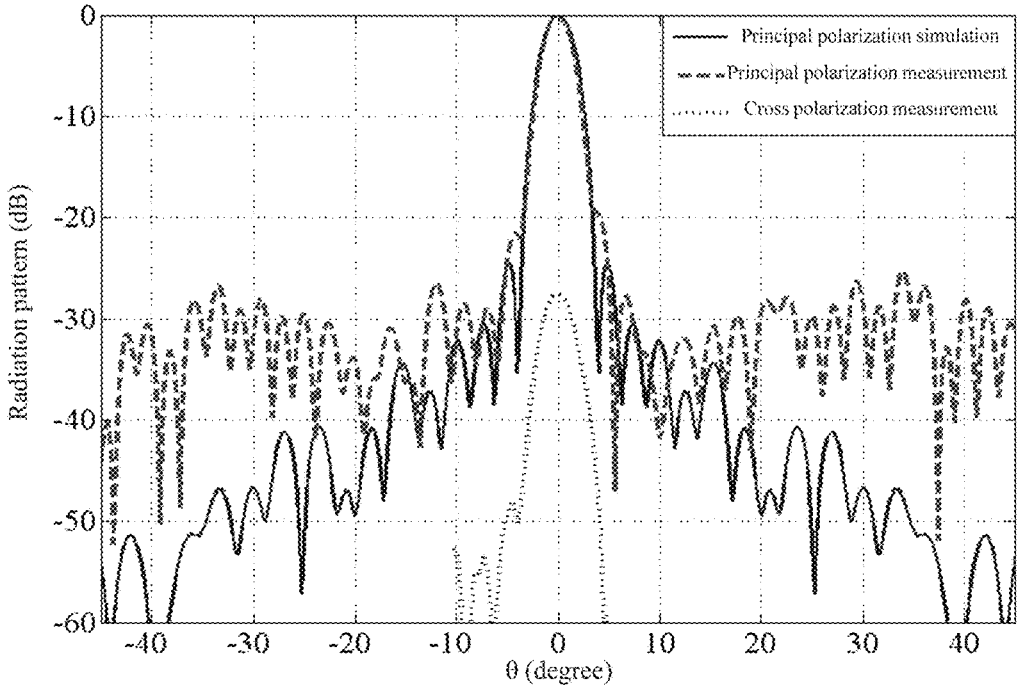
FIG. 9 is an H-plane pattern of a double-layer planar phase modulation device according to embodiments of the present disclosure.

In order to verify this design, an antenna array is designed based on this new kind of planar phase modulation device, and a field measurement is conducted in a compact-range microwave anechoic chamber. Firstly, a gain of a standard horn antenna used for illuminating the double-layer planar phase modulation device 10 is tested, and a relative level value thereof is recorded. Then, principle-polarization relative level values and cross-polarization relative level values of an E-plane antenna pattern and an H-plane antenna pattern of the antenna array based on the double-layer planar phase modulation device 10 are tested respectively, and further compared with the relative level value of the standard horn antenna. The test results of the E-plane antenna pattern and the H-plane antenna pattern of 20 GHz center frequency are shown in FIGS. 8 and 9 respectively. In order to facilitate a comparison analysis with the simulation results, a theoretical calculation result is superposed with the test curve.

As shown in FIGS. 8 and 9, a main lobe of the antenna simulation pattern is well coincident with that of the antenna test pattern at the center frequency. The 3 dB beam widths (i.e. the half-power beam widths) of the E-plane and the H-plane are 2.76° and 2.74° respectively, however all the simulation results are 3.05°. The main lobe beam starts to expand around −20 dB, which is 5 dB higher than a first side lobe level of the simulation result. The highest value of the E-plane cross polarization is −28 dB, and the highest value of the H-plane cross polarization is −30 dB. Although the side lobe level of the test pattern is higher than the theoretical calculation result, the vast majority thereof stays below −20 dB.

Embodiment 2

Figure 10:
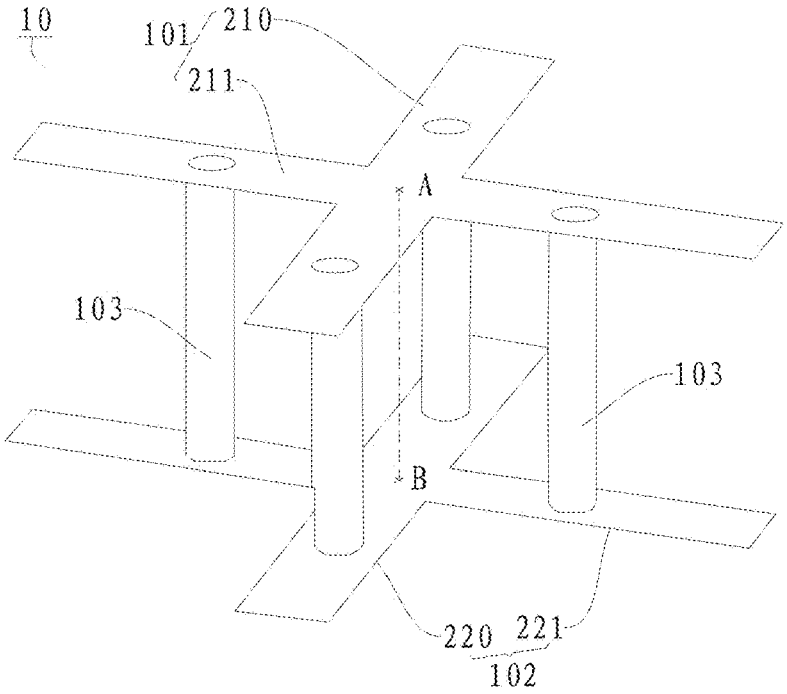
FIG. 10 is a schematic view of a double-layer planar phase modulation device according to embodiments of the present disclosure.
Figure 11:
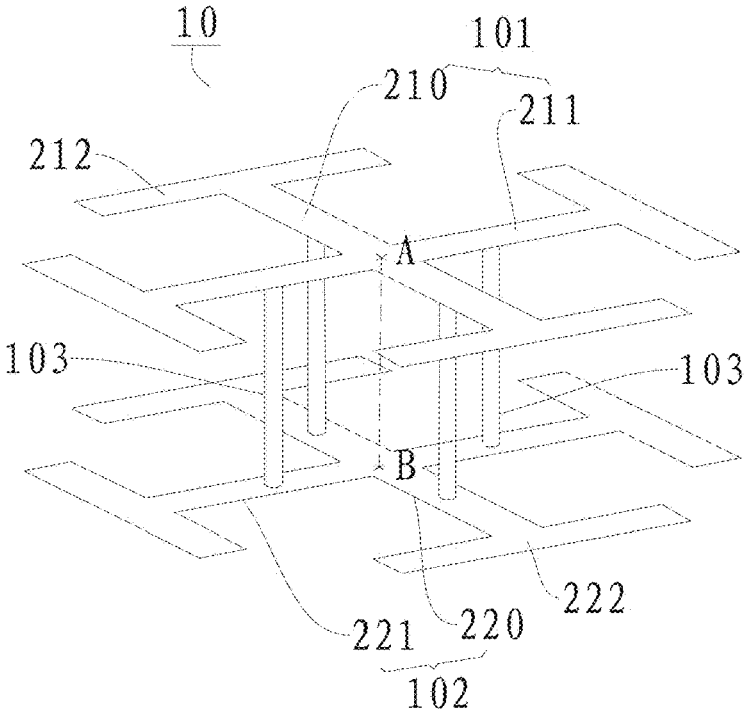
FIG. 11 is a schematic view of a double-layer planar phase modulation device according to embodiments of the present disclosure.
Figure 12:
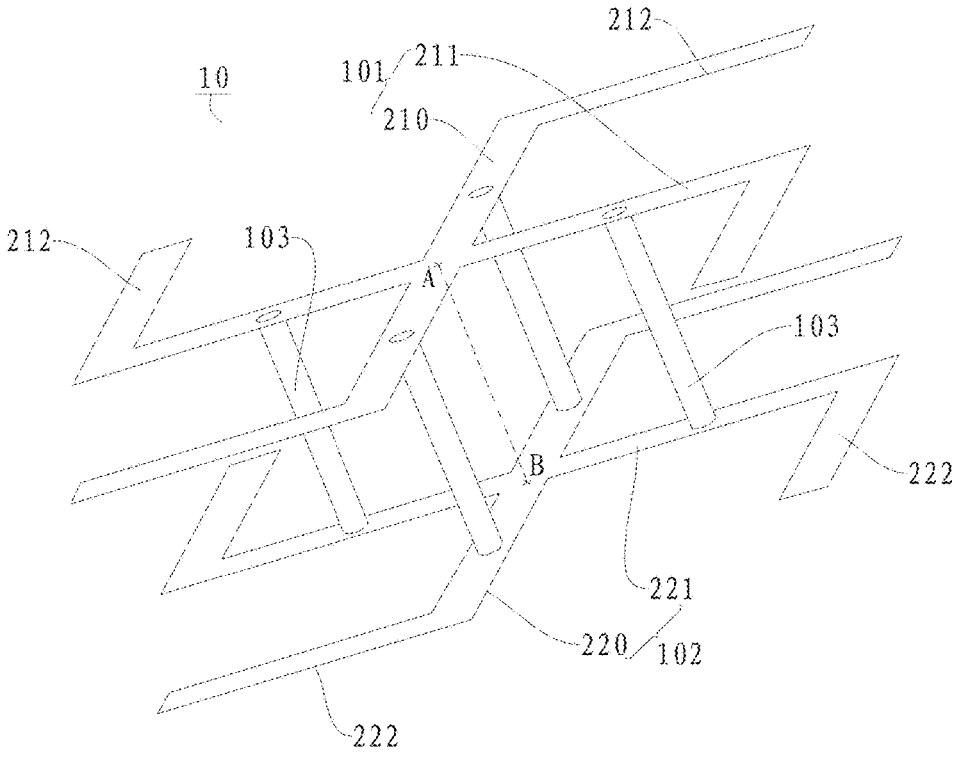
FIG. 12 is a schematic view of a double-layer planar phase modulation device according to embodiments of the present disclosure.

As shown in FIGS. 10-12, what is different from the above embodiment is that, in the present embodiment, the upper patch 101 may include a first upper main part 210 and a second upper main part 211 intersecting with the first upper main part 210, in which each of the first upper main part 210 and the second upper main part 211 may be configured to have a long-strip shape; and the lower patch 102 may include a first lower main part 220 and a second lower main part 221 intersecting with the first lower main part 220, in which each of the first lower main part 220 and the second lower main part 221 may be configured to have a long-strip shape. Thus, the structure of the double-layer planar phase modulation device 10 may be simplified, and the manufacturing cost of the double-layer planar phase modulation device 10 can be reduced.

Advantageously, as shown in FIGS. 10-12, the first upper main part 210 and the second upper main part 211 are perpendicular to and bisected by each other, and the first lower main part 220 and the second lower main part 221 are perpendicular to and bisected by each other as well. Thus, a flexible phase modulation of the double-layer planar phase modulation device 10 can be achieved.

Further, as shown in FIGS. 11-12, the upper patch 101 may include an upper end strip 212, and the upper end strip 212 may be disposed at a free end of at least one of the first upper main part 210 and the second upper main part 211. That is to say, two upper end strips 212 may be provided at two ends of the first upper main part 210 or provided at two ends of the second upper main part 211, and four upper end strips 212 may be provided at the two ends of the first upper main part 210 and the two ends of the second upper main part 211 respectively. Similarly, the lower patch 102 may include a lower end strip 222, and the lower end strip 222 may be disposed at a free end of at least one of the first lower main part 220 and the second lower main part 221. That is to say, two lower end strips 222 may be provide at two ends of the first lower main part 220 or provided at two ends of the second lower main part 221, and four lower end strips 222 may be provided at the two ends of the first lower main part 220 and the two ends of the second lower main part 221 respectively. Thus, the phase modulation range of the double-layer planar phase modulation device 10 can be enlarged and the phase modulation flexibility of the double-layer planar phase modulation device 10 can be improved.

Further, as shown in FIGS. 11-12, an extending direction of the upper end strip 212 is perpendicular to an extending direction of the corresponding first upper main part 210 or second upper main part 211, and an extending direction of the lower end strip 222 is perpendicular to an extending direction of the corresponding first lower main part 220 or second lower main part 221. It could be understood that, when each of the two ends of the first upper main part 210 is provided with the upper end strip 212, the extending direction of the upper end strip 212 is perpendicular to the extending direction of the first upper main part 210; when each of the two ends of the second upper main part 211 is provided with the upper end strip 212, the extending direction of the upper end strip 212 is perpendicular to the extending direction of the second upper main part 211; when each of the two ends of the first lower main part 220 is provided with the lower end strip 222, the extending direction of the lower end strip 222 is perpendicular to the extending direction of the first lower main part 220; when each of the two ends of the second lower main part 221 is provided with the lower end strip 222, the extending direction of the lower end strip 222 is perpendicular to the extending direction of the second lower main part 221. Thus, the phase modulation range of the double-layer planar phase modulation device 10 can be enlarged and the phase modulation flexibility of the double-layer planar phase modulation device 10 can be improved.

Further, in the embodiment shown in FIG. 11, the upper end strip 212 is symmetrical with respect to the first upper main part 210 or the second upper main part 211 where the upper end strip 212 is located, and the lower end strip 222 is symmetrical with respect to the first lower main part 220 or the second lower main part 221 where the lower end strip 222 is located. It could be understood that, when each of the two ends of the first upper main part 210 is provided with the upper end strip 212, the upper end strip 212 is symmetrical with respect to the first upper main part 210; when each of the two ends of the second upper main part 211 is provided with the upper end strip 212, the upper end strip 212 is symmetrical with respect to the second upper main part 211; when each of the two ends of the first lower main part 220 is provided with the lower end strip 222, the lower end strip 222 is symmetrical with respect to the first lower main part 220; when each of the two ends of the second lower main part 221 is provided with the lower end strip 222, the lower end strip 222 is symmetrical with respect to the second lower main part 221. Thus, the phase modulation range of the double-layer planar phase modulation device 10 can be enlarged and the phase modulation flexibility of the double-layer planar phase modulation device 10 can be improved.

In the embodiment shown in FIG. 12, an end of the upper end strip 212 is connected to the corresponding first upper main part 210 or second upper main part 211, and an end of the lower end strip 222 is connected to the corresponding first lower main part 220 or second lower main part 221. It could be understood that, when the two ends of the first upper main part 210 are provided with two upper end strips 212 respectively, the end of one of the two upper end strips 212 is connected to one end of the first upper main part 210, and the end of the other one of the two upper end strips 212 is connected to the other end of the first upper main part 210; when the two ends of the second upper main part 211 are provided with two upper end strip 212 respectively, the end of one of the two upper end strips 212 is connected to one end of the second upper main part 211, and the end of the other one of the two upper end strips 212 is connected to the other end of the second upper main part 211; similarly, when the two ends of the first lower main part 220 are provided with two lower end strips 222 respectively, the end of one of the two lower end strips 222 is connected to one end of the first lower main part 220, and the end of the other one of the two lower end strips 222 is connected to the other end of the first lower main part 220; when the two ends of the second lower main part 221 are provided with two lower end strips 222 respectively, the end of one of the two lower end strips 222 is connected to one end of the second lower main part 221, and the end of the other one of the two lower end strips 222 is connected to the other end of the second lower main part 221. Thus, the phase modulation range of the double-layer planar phase modulation device 10 can be enlarged and the phase modulation flexibility of the double-layer planar phase modulation device 10 can be improved.

The double-layer planar phase modulation device 10 further includes a conductive member, in which one end of the conductive member is connected to the upper patch 101, and the other end of the conductive member is connected to the lower patch 102. As shown in FIGS. 10-12, an upper end of the conductive member is connected to the upper patch 101, and a lower end of the conductive member is connected to the lower patch 102, in which a central axis of the conductive member may pass through an intersection of the first upper main part 210 and the second upper main part 211, and the central axis of the conductive member may also pass through an intersection of the first lower main part 220 and the second lower main part 221. For example, as shown in FIGS. 10-12, the intersection of the first upper main part 210 and the second upper main part 211 is denoted as A, the intersection of the first lower main part 220 and the second lower main part 221 is denoted as B, a connection line between intersections A and B is defined as a straight line AB and the central axis of the conductive member is coincident with the straight line AB. Thus, the coupling degree of the double-layer planar phase modulation device 10 can be enhanced and the transmission structure of the receiving/transmitting element is introduced into the double-layer planar phase modulation device 10, and also, the symmetrical structure design is adopted to make the double-layer planar phase modulation device 10 suitable for the circular polarization.

Of course, the number of the conductive members is not limited to this. For example, in the embodiment shown in FIGS. 10-12, the double-layer planar phase modulation device 10 may include a plurality of the conductive members, and the upper end of each conductive member is connected to the upper patch 101 and the lower end of each conductive member is connected to the lower patch 102. A straight line where each conductive member is located is parallel to the straight line AB, and the plurality of the conductive members are distributed evenly along a circumferential direction of the straight line AB (i.e., surrounding the straight line AB). In other words, projections of the plurality of the conductive members on a plane where the upper patch 101 or the lower patch 102 is located are situated on the same circle, and any two adjacent conductive members are spaced apart from each other by an equal distance. The double-layer planar phase modulation device 10 according to embodiments of the present disclosure, by providing the plurality of the conductive members, may further improve its own performance. Compared with the double-layer planar phase modulation device 10 without the conductive member, the double-layer planar phase modulation device 10 with the conductive member may improve the phase compensation range and the element magnitude. Optionally, the conductive member may be the metal via hole 103 or the metal pillar.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A double-layer planar phase modulation device, comprising:

an upper patch; and a lower patch, disposed opposite to the upper patch, wherein a shape of the lower patch is similar to that of the upper patch, and the lower patch is electrically connected with the upper patch, wherein the upper patch has a regular-polygon shape, each corner of the upper patch is provided with an upper groove extending along a radial direction of the upper patch, and an external end of the upper groove is open; and each corner of the lower patch is provided with an lower groove extending along a radial direction of the lower patch, and an external end of the lower groove is open, wherein the upper patch is connected with the lower patch via a plurality of conductive members, and the conductive member is configured as a metal via hole or a metal pillar, in which one end of the conductive member is connected with the upper patch, and the other end of the conductive member is connected with the lower patch, and wherein one conductive member is disposed between two adjacent upper grooves, one conductive member is disposed between two adjacent lower grooves, and one upper groove and one lower groove are disposed between two adjacent conductive members.

2. The double-layer planar phase modulation device according to claim 1, wherein the upper patch is configured as a centrosymmetrical structure.

3. The double-layer planar phase modulation device according to claim 1, wherein the upper groove runs through the upper patch along an up-down direction.

4. The double-layer planar phase modulation device according to claim 1, wherein the lower groove runs through the lower patch along the up-down direction.

5. The double-layer planar phase modulation device according to claim 1, wherein an internal end of each upper groove is spaced apart from a center of the upper patch by a predetermined distance, and an internal end of each lower groove is spaced apart from a center of the lower patch by the predetermined distance, in which the predetermined distance is determined by an operation frequency of the double-layer planar phase modulation device and sizes of the upper patch and the lower patch.

6. The double-layer planar phase modulation device according to claim 5, wherein a length of each upper groove is in a linear relationship with a side length of the upper patch; and a length of each lower groove is in a linear relationship with a side length of the lower patch.

7. The double-layer planar phase modulation device according to claim 1, wherein the two adjacent conductive members are symmetrical with respect to the upper groove located therebetween, and the two adjacent conductive members are symmetrical with respect to the lower groove located therebetween.

8. The double-layer planar phase modulation device according to claim 1, further comprising an insulating dielectric layer, disposed between the upper patch and the lower patch.

9. A double-layer planar phase modulation device, comprising:

an upper patch; and a lower patch, disposed opposite to the upper patch, wherein a shape of the lower patch is similar to that of the upper patch, and the lower patch is electrically connected with the upper patch, wherein the upper patch comprises a first upper main part and a second upper main part intersecting with the first upper main part, in which each of the first upper main part and the second upper main part is configured to have a rectangular shape; and the lower patch comprises a first lower main part and a second lower main part intersecting with the first lower main part, in which each of the first lower main part and the second lower main part is configured to have a rectangular shape, wherein the upper patch is connected with the lower patch via a plurality of conductive members, and the conductive member is configured as a metal via hole or a metal pillar, in which one end of the conductive member is connected with the upper patch, and the other end of the conductive member is connected with the lower patch, and wherein a central axis of the conductive member passes through an intersection of the first upper main part and the second upper main part, and the central axis of the conductive member passes through an intersection of the first lower main part and the second lower main part.

10. The double-layer planar phase modulation device according to claim 9, wherein the first upper main part and the second upper main part are perpendicular to each other and bisected by each other; and the first lower main part and the second lower main part are perpendicular to each other and bisected by each other.

11. The double-layer planar phase modulation device according to claim 9, wherein the upper patch further comprises an upper end strip, and the upper end strip is disposed at a free end of at least one of the first upper main part and the second upper main part; and the lower patch further comprises a lower end strip, and the lower end strip is disposed at a free end of at least one of the first lower main part and the second lower main part.

12. The double-layer planar phase modulation device according to claim 11, wherein an extending direction of the upper end strip is perpendicular to an extending direction of the corresponding first upper main part or second upper main part; and an extending direction of the lower end strip is perpendicular to an extending direction of the corresponding first lower main part or second lower main part.

13. The double-layer planar phase modulation device according to claim 12, wherein the upper end strip is symmetrical with respect to the first upper main part or the second upper main part where the upper end strip is disposed; and the lower end strip is symmetrical with respect to the first lower main part or the second lower main part where the lower end strip is disposed.

14. The double-layer planar phase modulation device according to claim 12, wherein an end of the upper end strip is connected to the corresponding first upper main part or second upper main part; and an end of the lower end strip is connected to the corresponding first lower main part or second lower main part.

15. A double-layer planar phase modulation device, comprising:

an upper patch; and a lower patch, disposed opposite to the upper patch, wherein a shape of the lower patch is similar to that of the upper patch, and the lower patch is electrically connected with the upper patch, wherein the upper patch comprises a first upper main part and a second upper main part intersecting with the first upper main part, in which each of the first upper main part and the second upper main part is configured to have a rectangular shape; and the lower patch comprises a first lower main part and a second lower main part intersecting with the first lower main part, in which each of the first lower main part and the second lower main part is configured to have a rectangular shape, wherein the upper patch is connected with the lower patch via a plurality of conductive members, and the conductive member is configured as a metal via hole or a metal pillar, in which one end of the conductive member is connected with the upper patch, and the other end of the conductive member is connected with the lower patch, and wherein an intersection of the first upper main part and the second upper main part is denoted as A, an intersection of the first lower main part and the second lower main part is denoted as B, and a connection line between intersections A and B is defined as a straight line AB; and an upper end of each conductive member is connected to the upper patch and a lower end of each conductive member is connected to the lower patch, a straight line where each conductive member is located is parallel to the straight line AB, and the plurality of the conductive members are distributed evenly along a circumferential direction of the straight line AB.

* * * * *